US008214953B2

(12) United States Patent
Wang

(10) Patent No.: US 8,214,953 B2
(45) Date of Patent: Jul. 10, 2012

(54) SELF-ENCLOSABLE INFLATABLE MATTRESS

(75) Inventor: Cheng-Chung Wang, Taipei (TW)

(73) Assignee: Team Worldwide Corp. (TW)

( * ) Notice: Subject to any disclaimer, the term of this patent is extended or adjusted under 35 U.S.C. 154(b) by 303 days.

(21) Appl. No.: 12/476,105

(22) Filed: Jun. 1, 2009

(65) Prior Publication Data

US 2010/0299842 A1 Dec. 2, 2010

(51) Int. Cl.
*A47C 27/08* (2006.01)

(52) U.S. Cl. ..... 5/706; 5/417

(58) Field of Classification Search ..... 5/706, 708, 5/713, 417, 419, 420
See application file for complete search history.

(56) References Cited

U.S. PATENT DOCUMENTS

| | | | | |
|---|---|---|---|---|
| 6,223,367 | B1 * | 5/2001 | French et al. | 5/419 |
| 6,287,095 | B1 * | 9/2001 | Saputo et al. | 417/472 |
| 7,401,370 | B2 | 7/2008 | McClintock | |
| 2006/0037144 | A1 * | 2/2006 | Rockstad | 5/706 |

* cited by examiner

*Primary Examiner* — Fredrick Conley
(74) *Attorney, Agent, or Firm* — Hershkovitz & Associates, LLC

(57) ABSTRACT

A self-enclosable inflatable mattress has a mattress body, a valve and a bag. The mattress body has a sidewall and a chamber being defined in the mattress body. The valve is mounted through the mattress body. The bag is attached to the mattress body and has a surrounding sheet, at least one holding sheet and at least one fastener. The at least one holding sheet is mounted on a corresponding margin of the surrounding sheet and detachably connected to a corresponding surrounding sheet. The fastener is mounted between the surrounding sheet and the holding sheet. The self-enclosable inflatable mattress is easily stored compactly and prevents dust from contacting the mattress body during storage.

18 Claims, 16 Drawing Sheets

SELF-ENCLOSABLE INFLATABLE MATTRESS

BACKGROUND OF THE INVENTION

1. Field of the Invention

The present invention relates to a mattress, and more particularly to a self-enclosable inflatable mattress having a bag formed on a body for folding therein.

2. Description of the Prior Art

Inflatable mattresses are designed to be compressible and portable for traveling and camping. Since the inflatable mattresses are easy to store without occupying too much space, they are also popular in families that do not have a guestroom for receiving visitors.

With reference to FIG. 16, a conventional inflatable mattress comprises a mattress body (90) and a fastener (80). The mattress body (90) is resilient, is selectively inflated and deflated and has a single air chamber defined in the mattress body (90). The fastener (80) is attached to a side of the mattress body (90). To retract the conventional inflatable mattress, the mattress body (90) is deflated, folded longitudinally and rolled around a transverse axis. Then the fastener (80) is wound around the mattress body (90) to hold the mattress body (90) rolled. Therefore, the conventional inflatable mattress is compressed to a smaller volume for convenient storage.

However, since the single fastener (80) is attached in one place to the mattress body (90), the mattress body (90) might loosen and unroll, especially when carried, removed from a tight storage place or dropped, causing the mattress body (90) to require refolding and rolling, dirtying a surface of the mattress body (90) or maybe puncturing or tearing the mattress body (90), especially if dropped outside, and inconveniencing transportation, storage and use. Furthermore, during transport and storage the surface of the mattress body (90) may be covered by dust or dirt thus requires cleaning prior to use, especially inconvenient when camping.

A conventional inflatable mattress was disclosed in U.S. Pat. No. 7,401,370 B2. The inflatable mattress has a mattress body and a sleeve. The sleeve may be a flat fabric material, is attached to the mattress body, is extended from the mattress body and has two cinch mechanism. The cinch mechanism is formed on and extended along a side of the sleeve, selectively ties and tightens the sleeve around the mattress body and has a channel and a drawstring or a cord. The channel is formed through the cinch mechanism. The drawstring is mounted through the channel and selectively ties and tightens the sleeve around the mattress body. A similar conventional inflatable mattress was also disclosed in US publication NO. 2006/0037144 A1.

Although the mattress body can be covered by the sleeve, a part of the mattress body is still exposed to the air. Further, to use the drawstrings or cords of the cinch mechanism to tie and tighten the sleeve around the mattress body is relatively inconvenient. Moreover, the sleeve is limited to be made of flat fabric material, especially those with more flexibility for compactly wrapping the mattress body.

To overcome the shortcomings, the present invention provides a self-enclosable inflatable mattress to mitigate or obviate the aforementioned problems.

SUMMARY OF THE INVENTION

The main objective of the invention is to provide a self-enclosable inflatable mattress having a mattress body and an bag mounted on a surface of the mattress body, so that the mattress body can be easily stored in the bag, which is selectively flattened or accommodates the mattress body.

The self-enclosable inflatable mattress in accordance with the present invention comprises a mattress body and a bag.

The mattress body has a sidewall and a chamber. The chamber is defined in the mattress body.

The bag is connected to the mattress body and has a surrounding sheet, at least one holding sheet and at least one fastener. The surrounding sheet has a margin. The margin has at least one attaching segment. The at least one holding sheet is attached to the surrounding sheet and has a periphery. The periphery has an attaching section. The attaching section of the holding sheet is detachably connected to the corresponding attaching segment of the surrounding sheet, when the mattress body is encompassed by in the bag and when the bag is in an enclosed configuration. The at least one fastener is mounted between the attaching segment of the surrounding sheet and the attaching section of each holding sheet.

Thus, during transport and storage the surface of the mattress body may be covered by the bag without requiring further cleaning prior to use. Further, since the bag around the mattress body is not fastened by cinch mechanisms, the bag is not limited to be made of flexible material but can also be made of more rigid material such as canvas.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
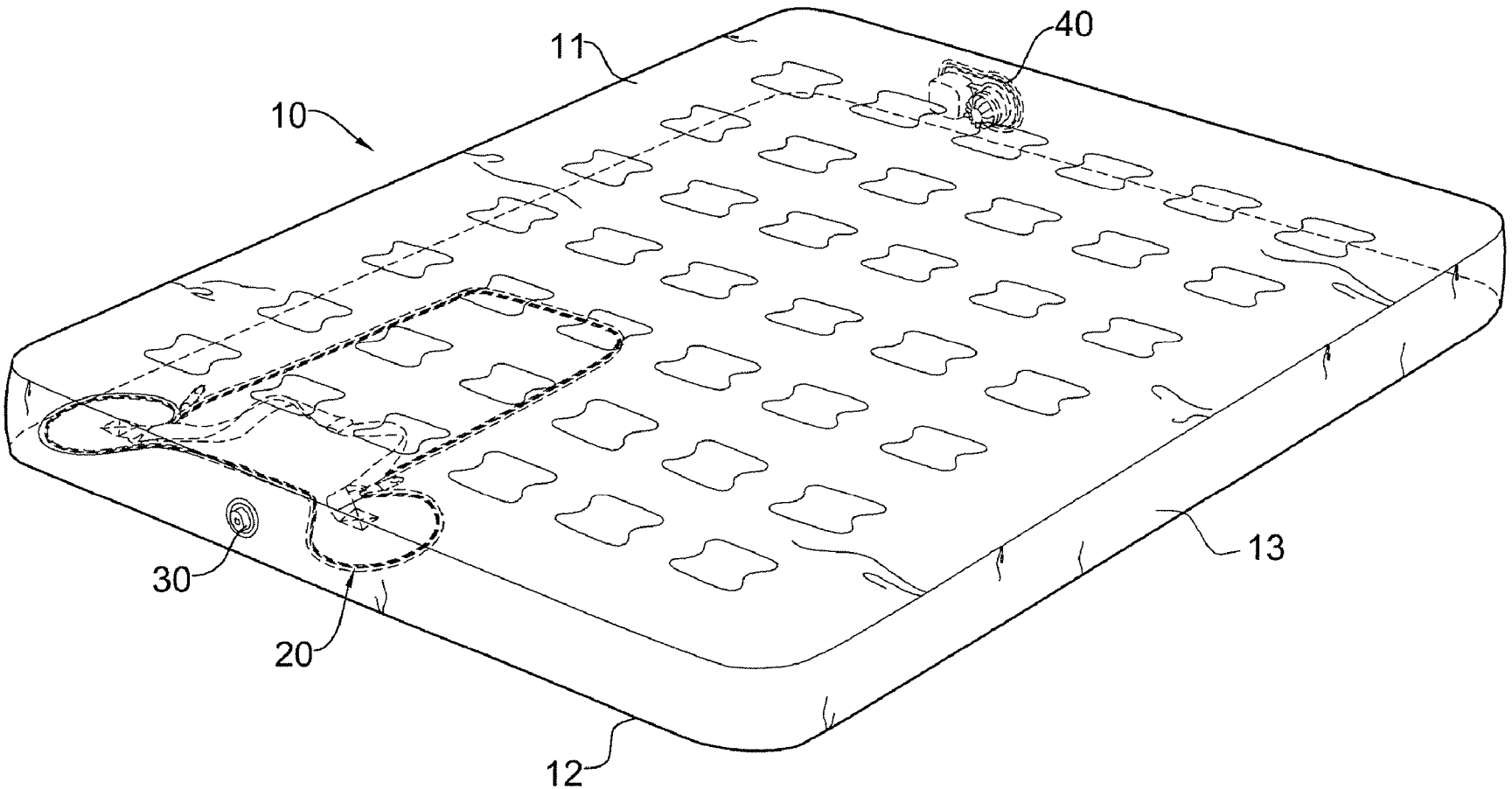
FIG. 1 is a perspective view of a self-enclosable inflatable mattress in accordance with the present invention.
Figure 2A:
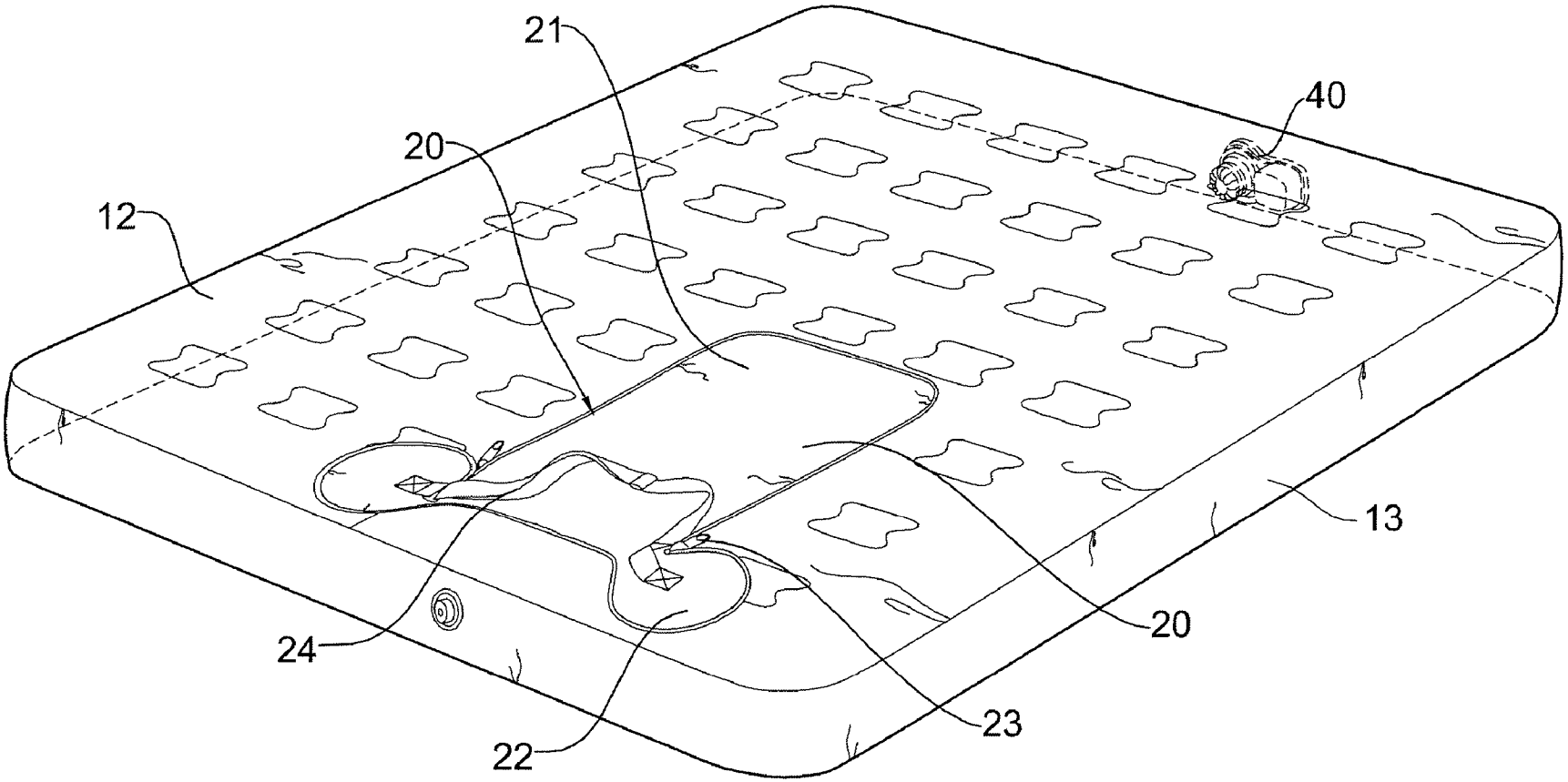
FIG. 2A is another perspective view of the self-enclosable inflatable mattress in FIG. 1.
Figure 2B:
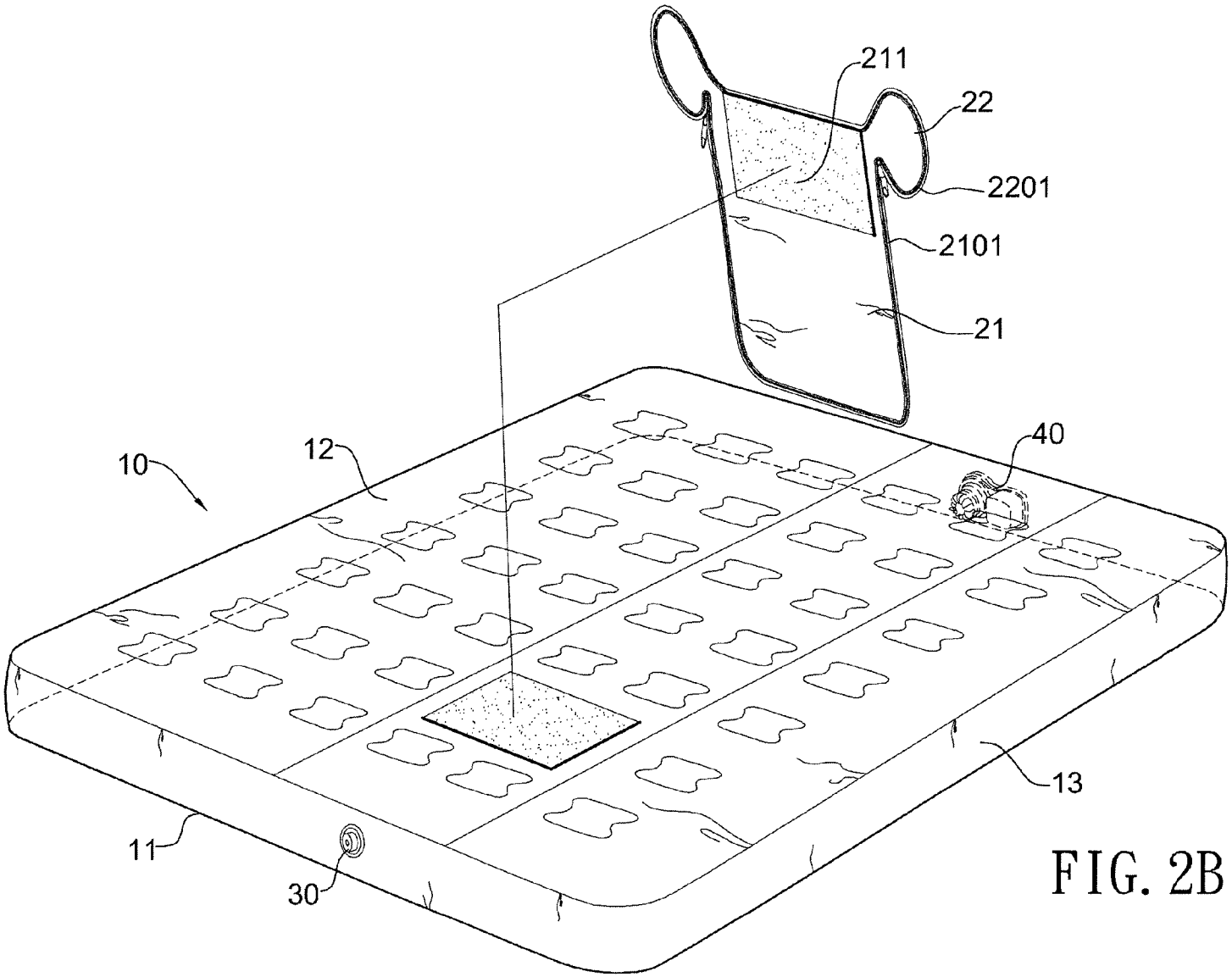
FIG. 2B is an exploded perspective view of the self-enclosable inflatable mattress in FIG. 1.

With reference to FIGS. 1 and 2A to 2B, a self-enclosable inflatable mattress in accordance with the present invention comprises a mattress body (10), an optional valve (30), a bag (20), and an optional air pump assembly (40).

The mattress body (10) may be rectangular, may be a resilient material and has a top (11), a bottom (12), a sidewall (13) and a chamber. The chamber is defined in the mattress body (10).

Multiple partitions are formed in the chamber between the top (11) and bottom (12) to retain a shape and may be aligned to facilitate folding and rolling.

The valve (30) is mounted through the mattress body (10), may be mounted through the sidewall (13) of the mattress body (10), protrudes into the chamber and selectively allows air to flow through the valve (30) to and from the mattress body (10).

The bag (20) is attached to the bottom (12) of the mattress body by sewing, adhering or welding and has a surrounding sheet (21), at least one holding sheet (22), at least one fastener (23) and optional at least one strap (24).

The surrounding sheet (21) may be rectangular, is connected to the mattress body (10) and has a margin (2101), and an optional attaching surface (211). The margin (2101) has at least one attaching segment. The attaching segment of the surrounding sheet (21) has a length. The attaching surface (211) of the surrounding sheet (21) is attached to the mattress body (10) and may be rectangular. The surrounding sheet (21) may be connected to the bottom (12) of the mattress body (10).

The at least one holding sheet (22), may be elliptical, has multiple optional breathing holes and is connected to the surrounding sheet (21), optionally aside the attaching surface (211) of the surrounding sheet (21) and has an periphery (2201) and an outer surface. Preferably two holding sheets (22) are implemented. The periphery (2201) has an attaching section and an optional fixing portion. The attaching section of the periphery (2201) of the holding sheet (22) may have a length equivalent to the length of the corresponding attaching segment of the margin (2101) of the surrounding sheet (21). The outer surface of the at least one holding sheet (22) is opposite to the attaching surface (211) of the surrounding sheet (21). The fixing portion of each holding sheet (22) is connected to a corresponding margin (2101) of the surrounding sheet (21).

The at least one fastener (23) may be a zip, a hook and loop fastener, strap, clip or the like and is mounted between the attaching segment of the margin (2101) of the surrounding sheet (21) and the attaching section of the periphery (2201) of the corresponding holding sheet (22) when the mattress body (10) is encompassed by the bag (20) and when the bag (20) is in an enclosed configuration. The strap (24) may be attached to the holding sheet (22) by sewing, adhering or welding and has two ends. The ends of each strap (24) may be respectively attached to the outer surface of the two holding sheets (22) or to the surrounding sheet (21) of the bag (20).

The air pump assembly (40) is mounted through the sidewall (13) of the mattress body (10), protrudes into the chamber inside the mattress body (10) and selectively inflates or deflates the mattress body (10).

Figure 8:
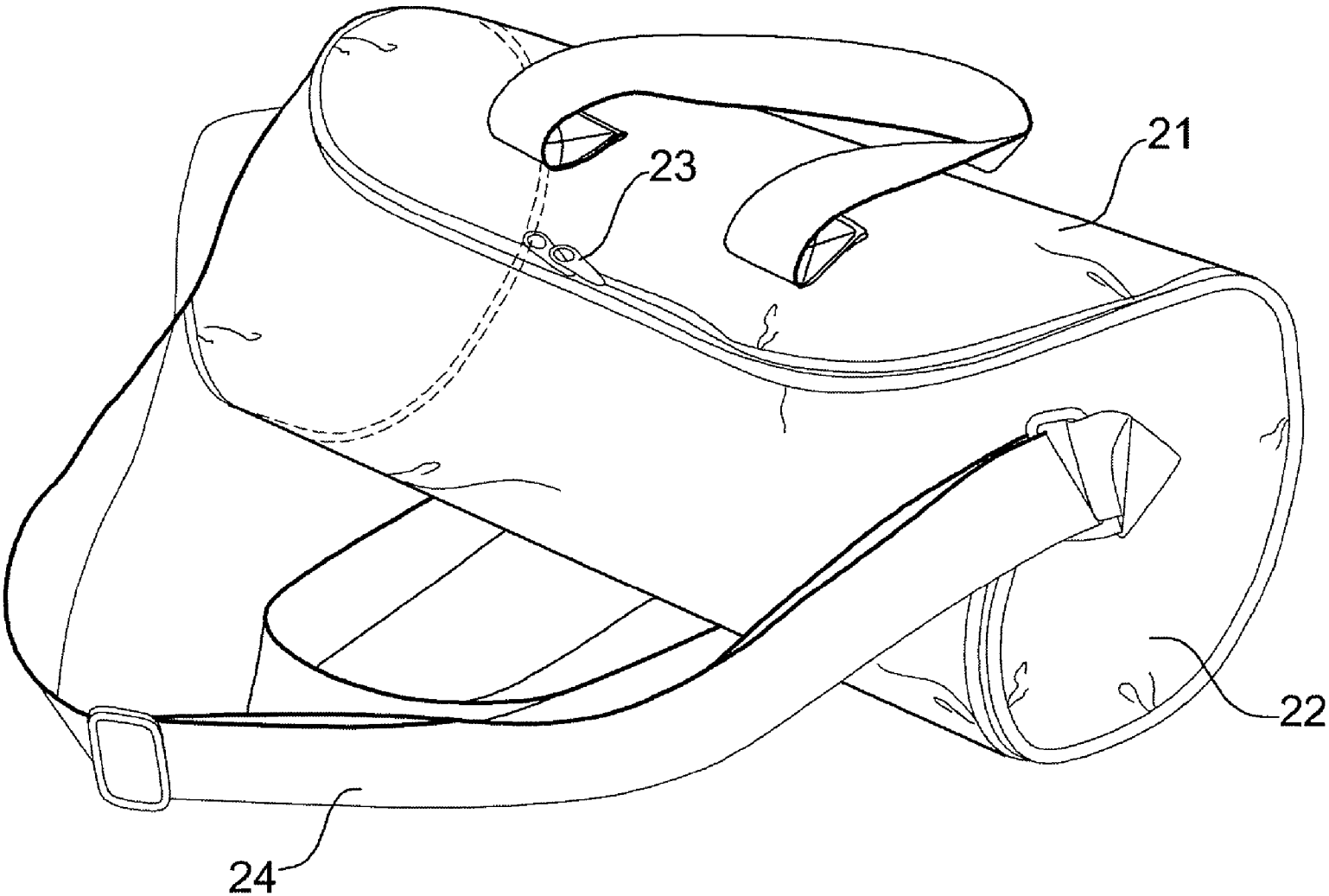
FIG. 8 is a perspective view of a self-enclosable inflatable mattress in accordance with the present invention shown self-enclosed.

In a preferred embodiment of the present invention, with reference to FIG. 8, multiple straps (24) are implemented.

Figure 9:
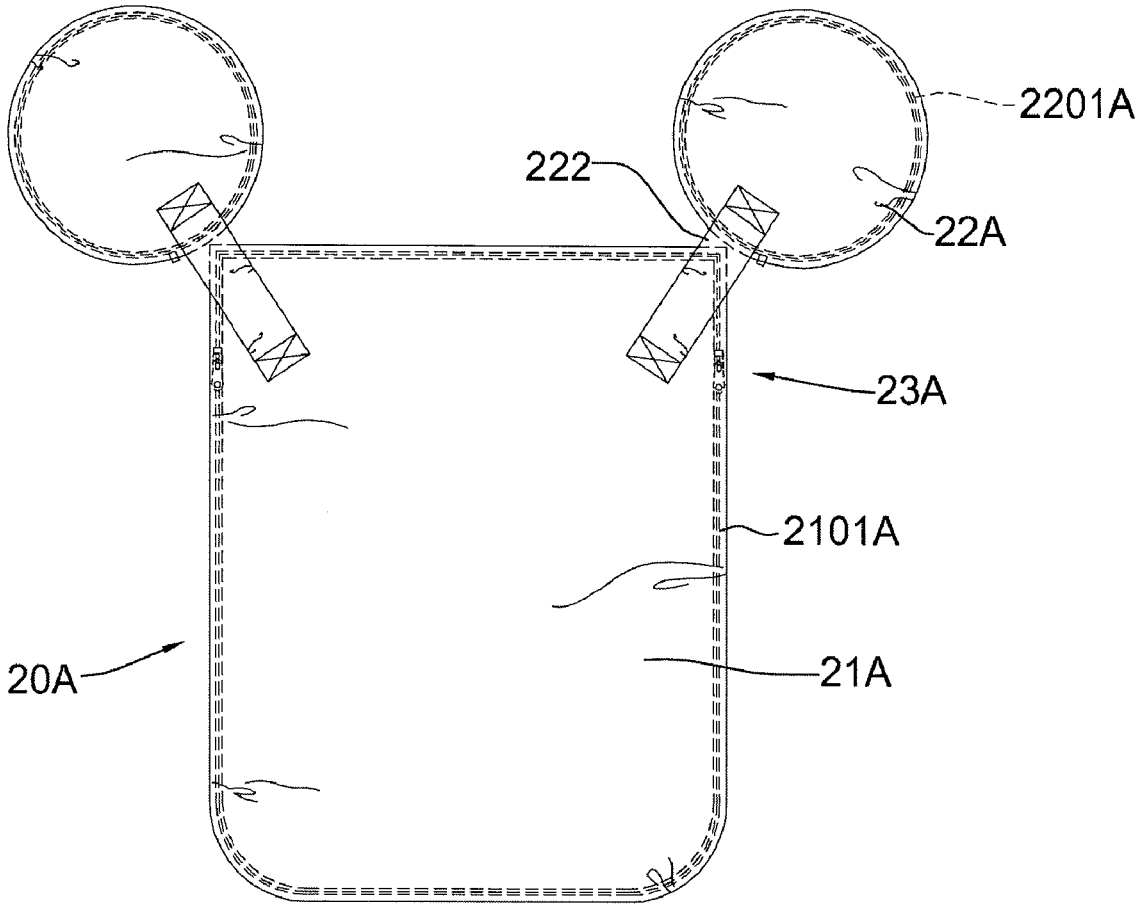
FIG. 9 is a side view of a bag of a self-enclosable inflatable mattress in accordance with the present invention.
Figure 10:
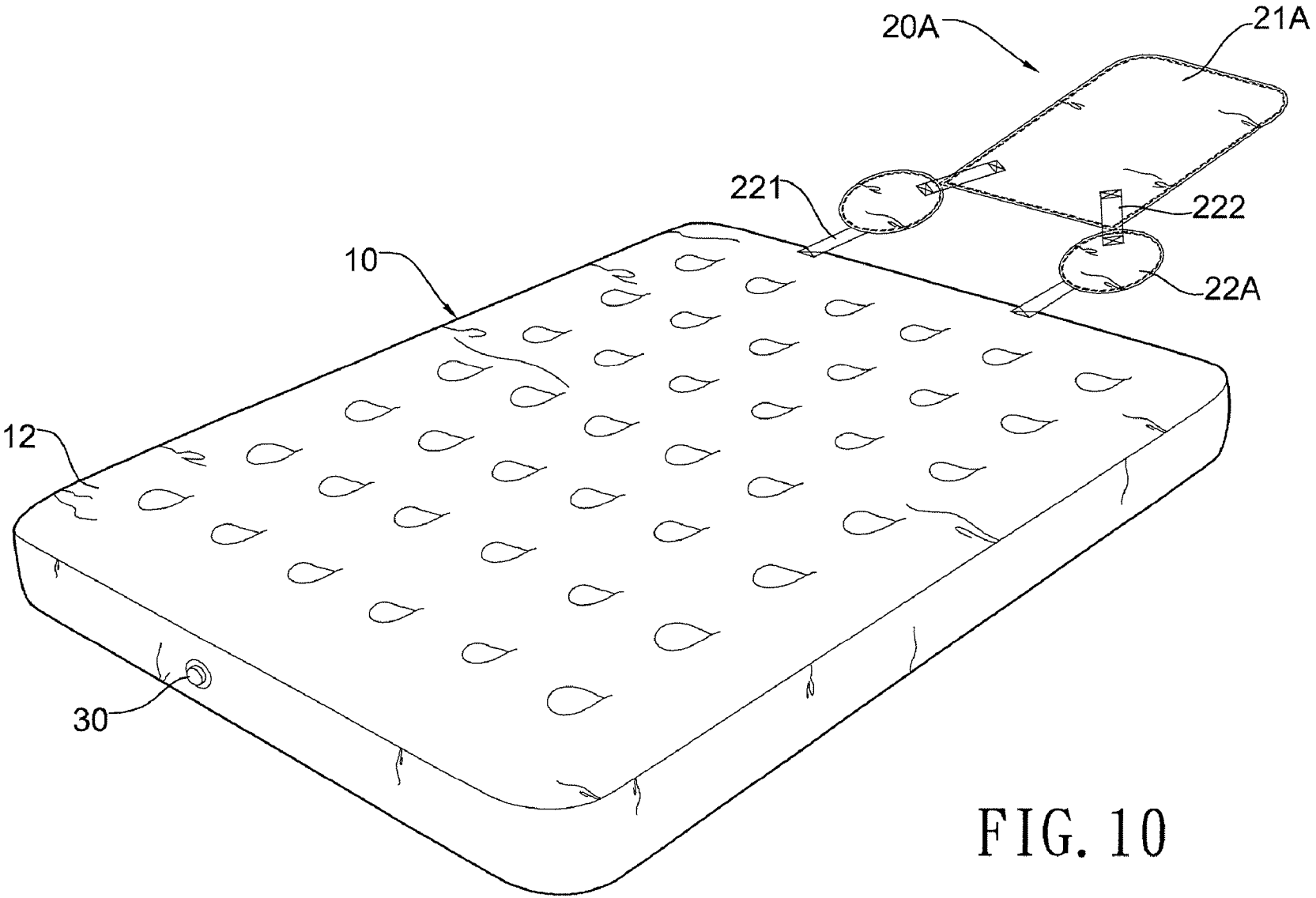
FIG. 10 is a perspective view of a self-enclosable inflatable mattress in accordance with the present invention with the bag in FIG. 9 with tapes in accordance with the present invention.

In a preferred embodiment of the present invention, with reference to FIGS. 9 and 10, the holding sheet (22A) further has at least one tape (221) and at least one connecting band (222). The tape (221) is mounted between and connects the holding sheet (22A) of the bag (20A) and the bottom (12) of the mattress body (10). The connecting band (222) is mounted between and connects the surrounding sheet (21A) and the holding sheet (22A).

Figure 11:
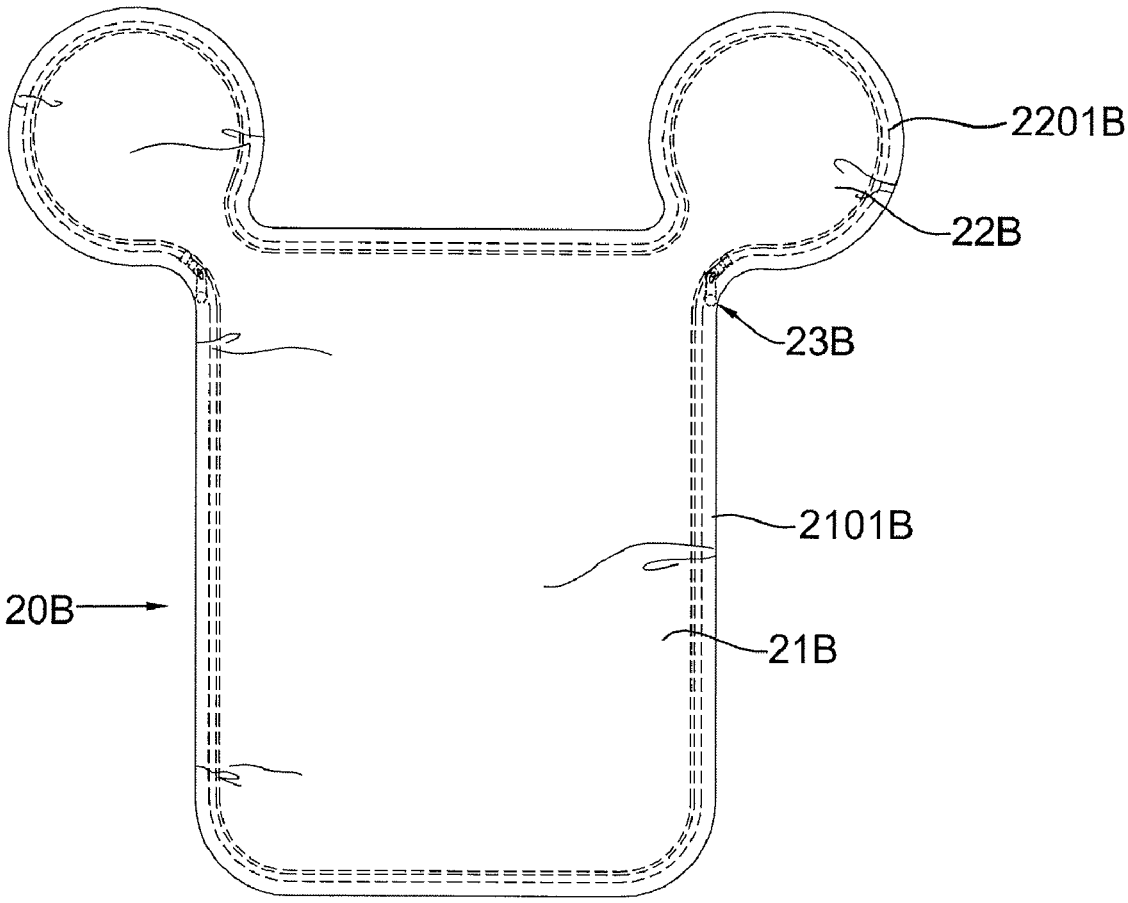
FIG. 11 is a side view of another bag of a self-enclosable inflatable mattress in accordance with the present invention.
Figure 12:
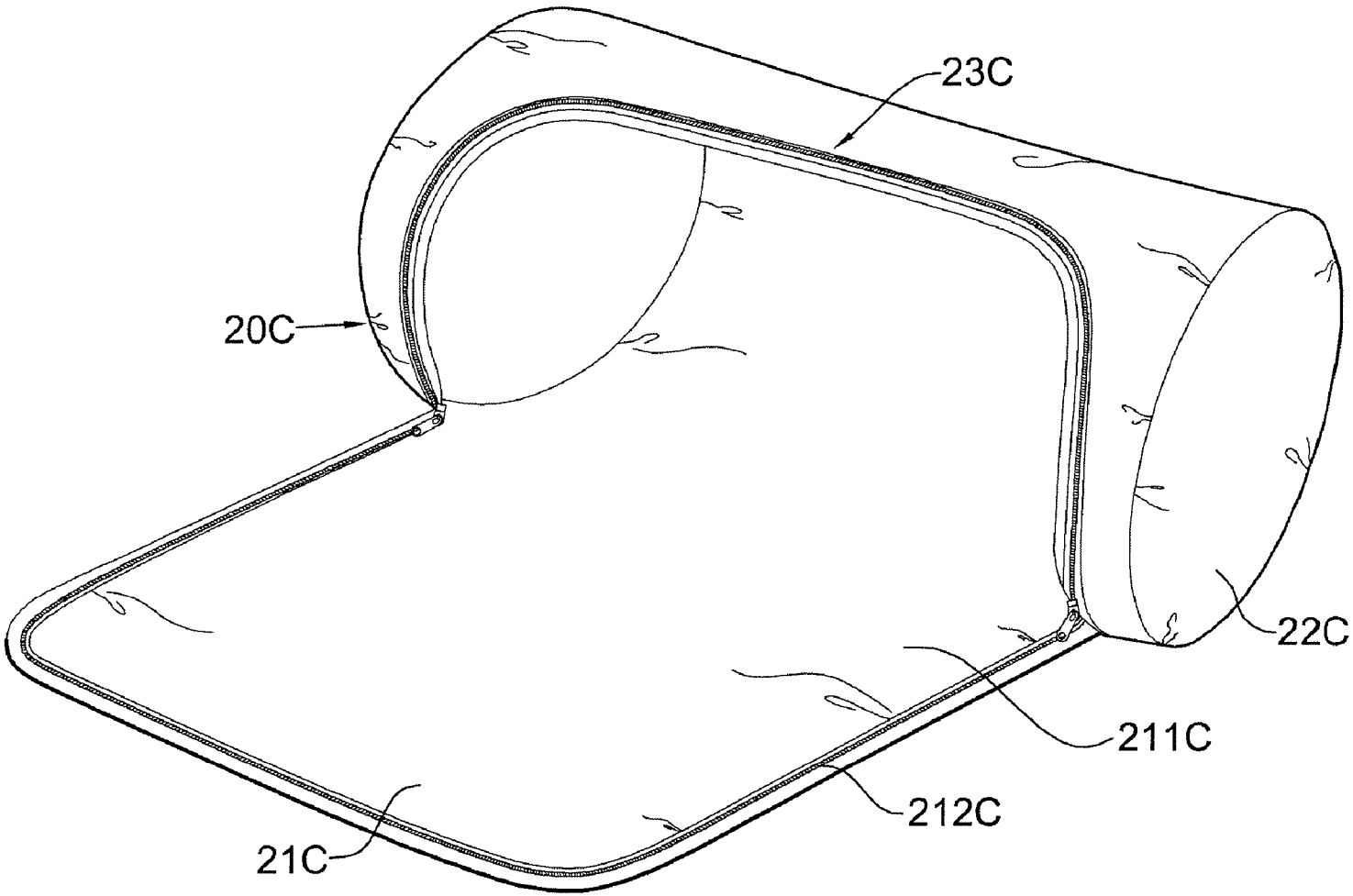
FIG. 12 is a perspective view of another bag of a self-enclosable inflatable mattress in accordance with the present invention.
Figure 13:
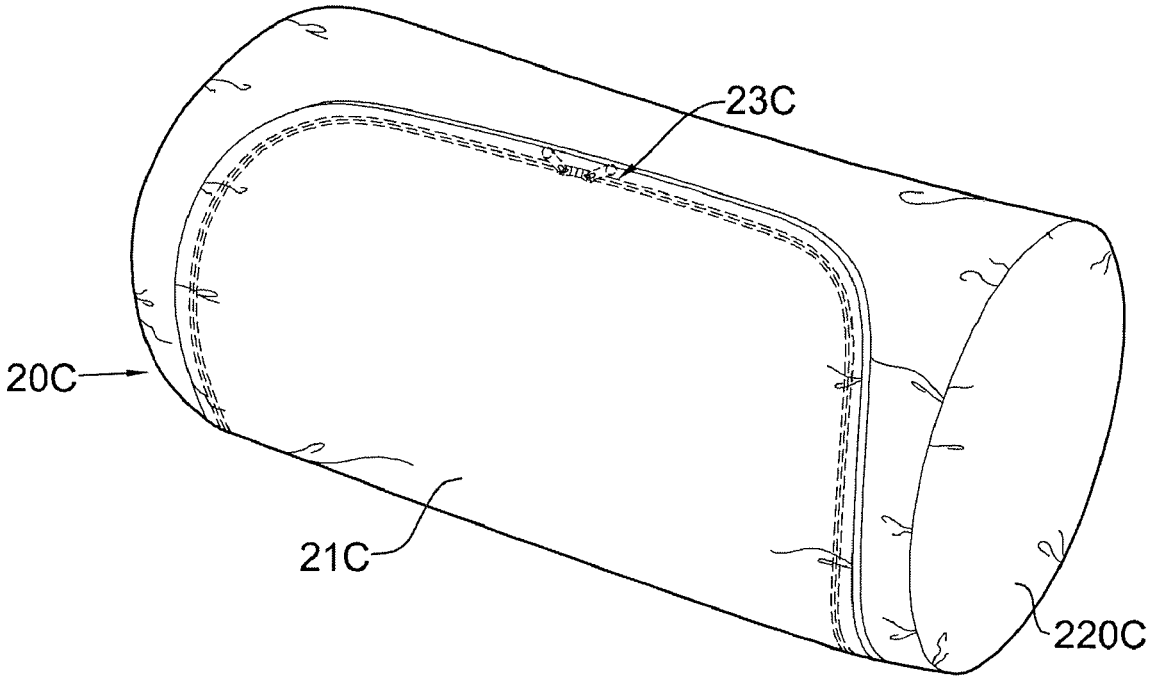
FIG. 13 another operational perspective view of the bag in FIG. 12 shown self-enclosed.
Figure 14:
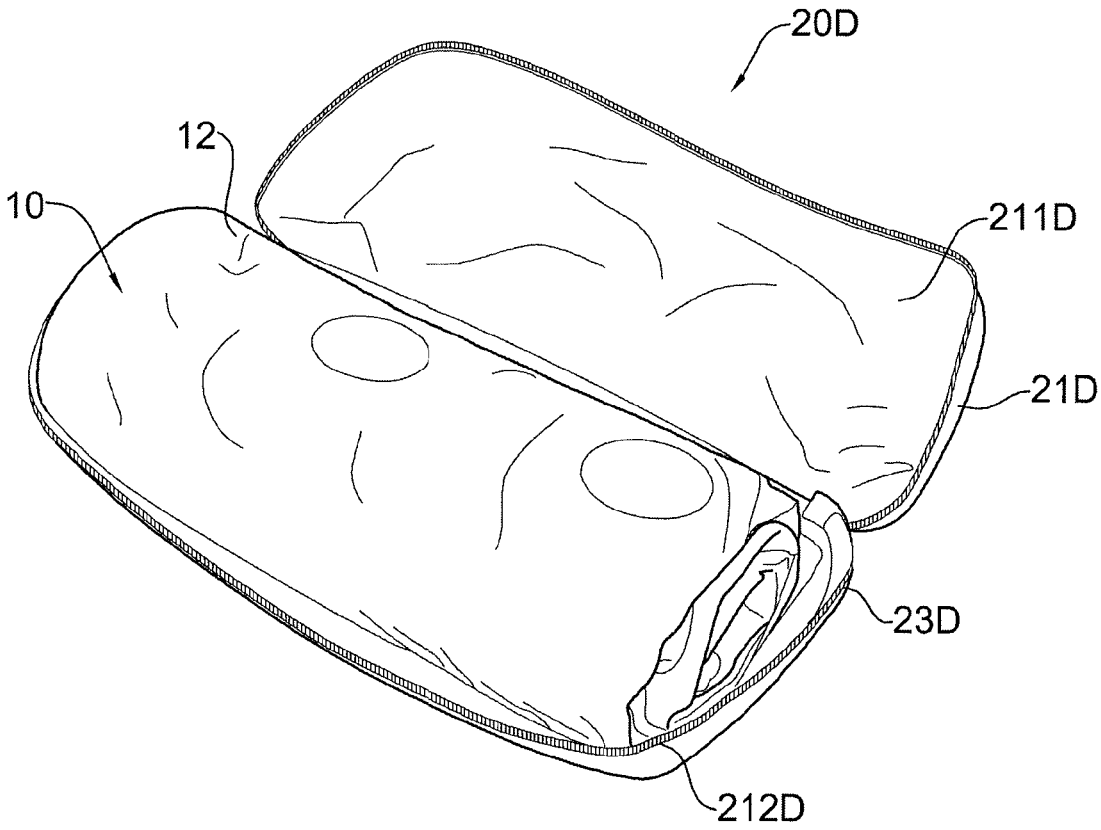
FIG. 14 is an operational perspective view of a self-enclosable inflatable mattress in accordance with the present invention.
Figure 15:
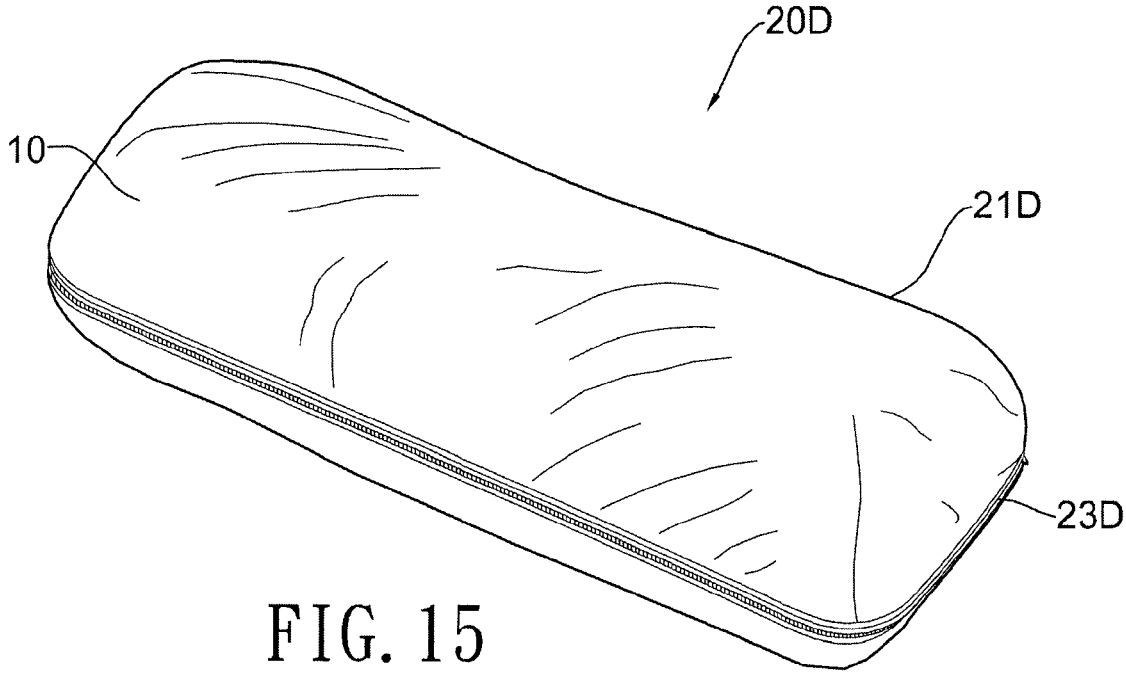
FIG. 15 is another operational perspective view of the self-enclosable inflatable mattress in FIG. 14.
Figure 16:
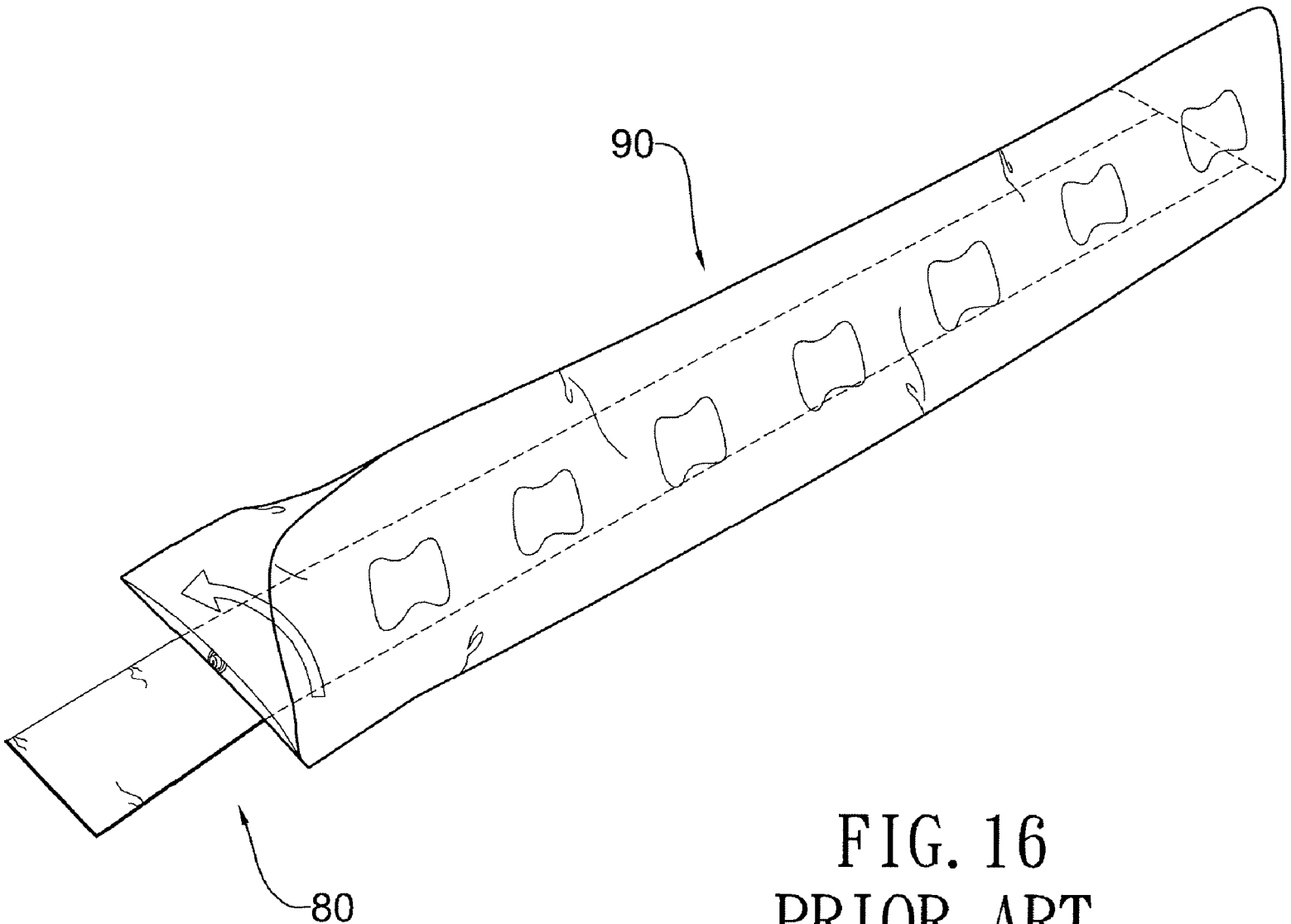
FIG. 16 PRIOR ART
FIG. 16 is a perspective view of an inflatable mattress in accordance with the prior art.

In another preferred embodiment of the present invention, with reference to FIG. 11, the fixing portion of the periphery (2201B) of the holding sheet (22B) is connected to the margin (2101B) of the surrounding sheet (21B). The fastener (23B) is a zip and is mounted between an inner surface of the attaching segment of the margin (2101B) of the surrounding sheet (21B) and an inner surface of the attaching section of the periphery (2201B) of the holding sheet (22B). Accordingly, the zip is enclosed in the bag (20) and is invisible from outside of the bag (20) to allow the surrounding sheet (21B) and the at least one holding sheet (22B) to be attached to each other and to encompass the mattress body (10).

In another preferred embodiment of the present invention, with further reference to FIGS. 12 to 13 or 14 to 15, the bag (20C, 20D) implemented hereby is cylindrical or rectangular and attached to the mattress body (10) and has an inner surface (211C, 211D), a looped edge (212C, 212D) and a fastener (23C, 23D). The inner surface (211C, 211D) is attached to the bottom (12) of the mattress body (10). The fastener (23C, 23D) is mounted on the looped edge (212C, 212D) to allow a portion of the looped edge (212C, 212D) to attach to another portion of the looped edge (212C, 212D), such that the inner surface (211C, 211D) of the bag (20C, 20D) defines a chamber for accommodating the mattress body (10). Preferably, the fastener (23C, 23D) is a zip.

Figure 3:
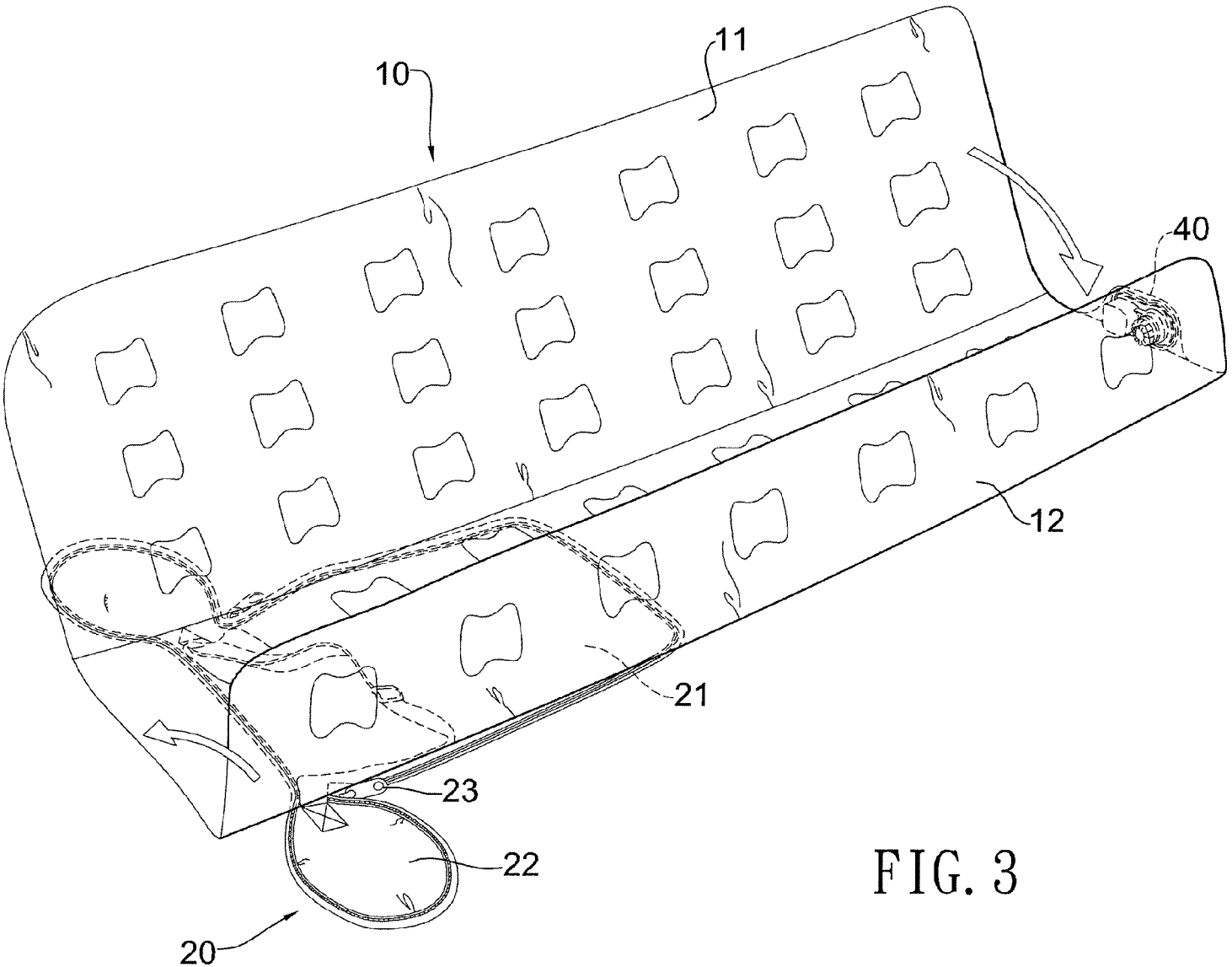
FIG. 3 is an operational perspective view of the self-enclosable inflatable mattress in FIG. 1 showing the mattress body being folded.
Figure 4:
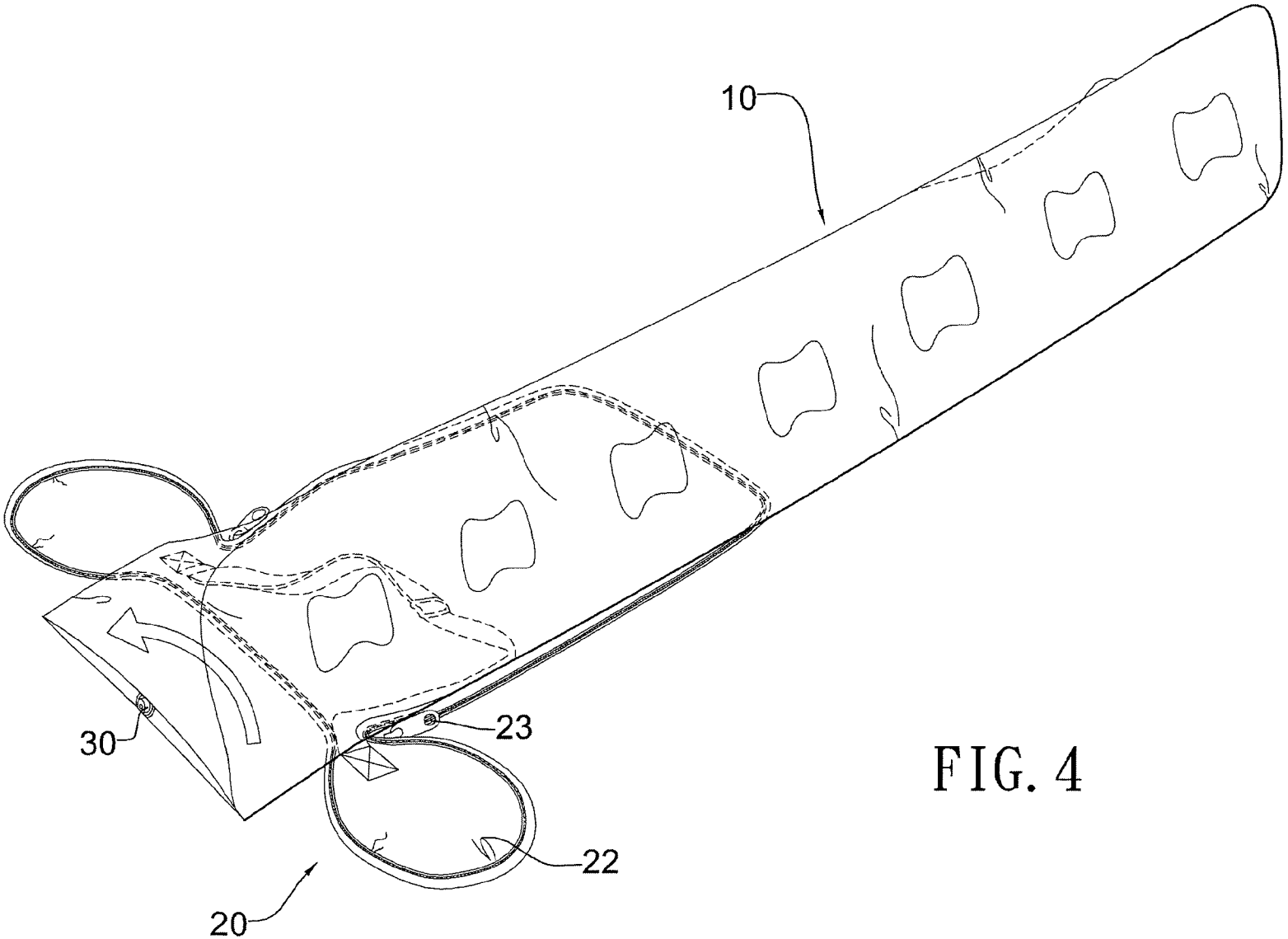
FIG. 4 is another operational perspective view of the self-enclosable inflatable mattress in FIG. 1 showing the mattress body being folded.
Figure 5:
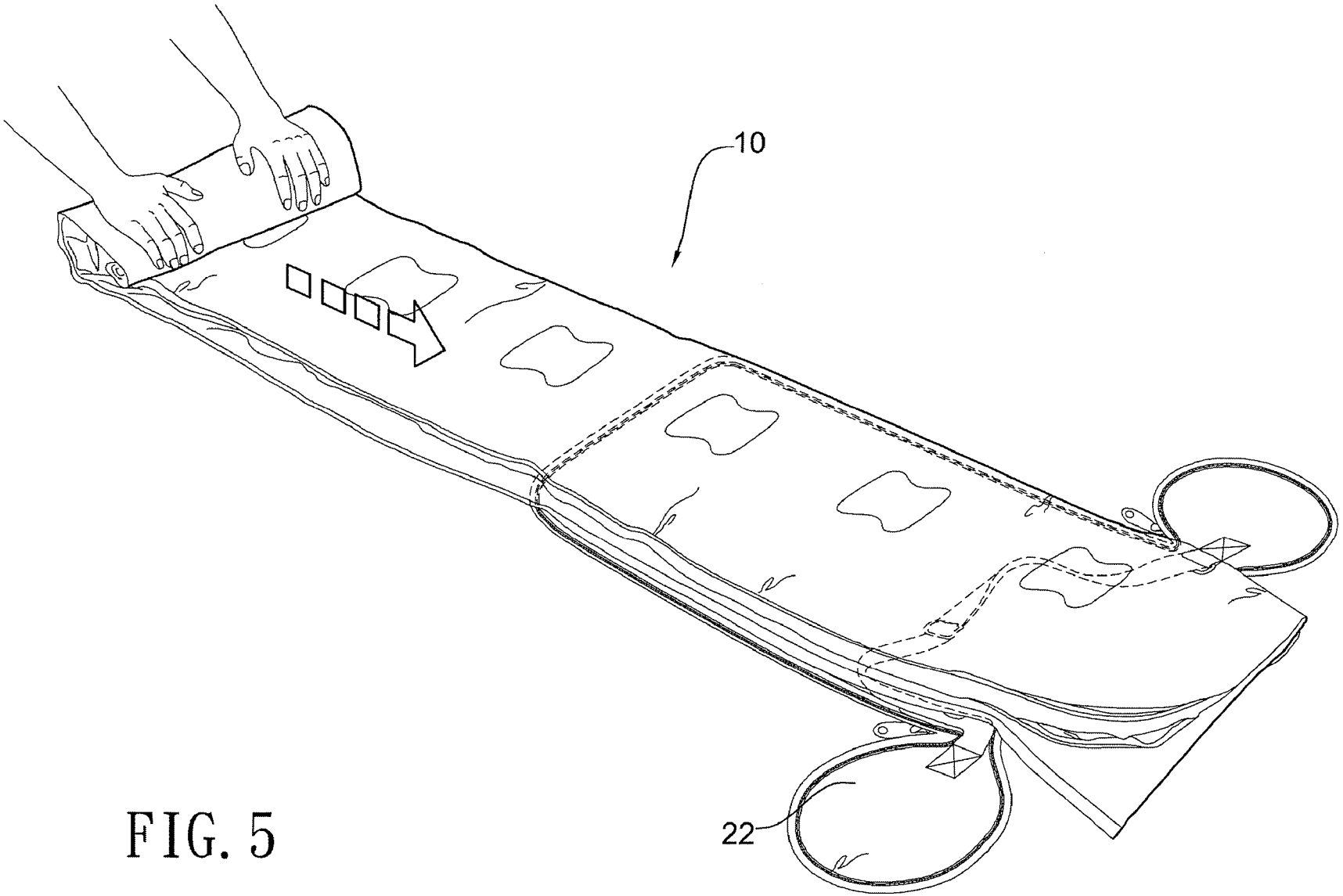
FIG. 5 is another operational perspective view of the self-enclosable inflatable mattress in FIG. 1 showing the mattress body being rolled into a bag formed on the body.

When in use, with further reference to FIGS. 3 to 5, the self-enclosable inflatable mattress as described is stored by first deflating the mattress body (10), then folding the mattress body (10) across its width and rolling along a transverse axis to form a rolled mattress body (10).

Figure 6:
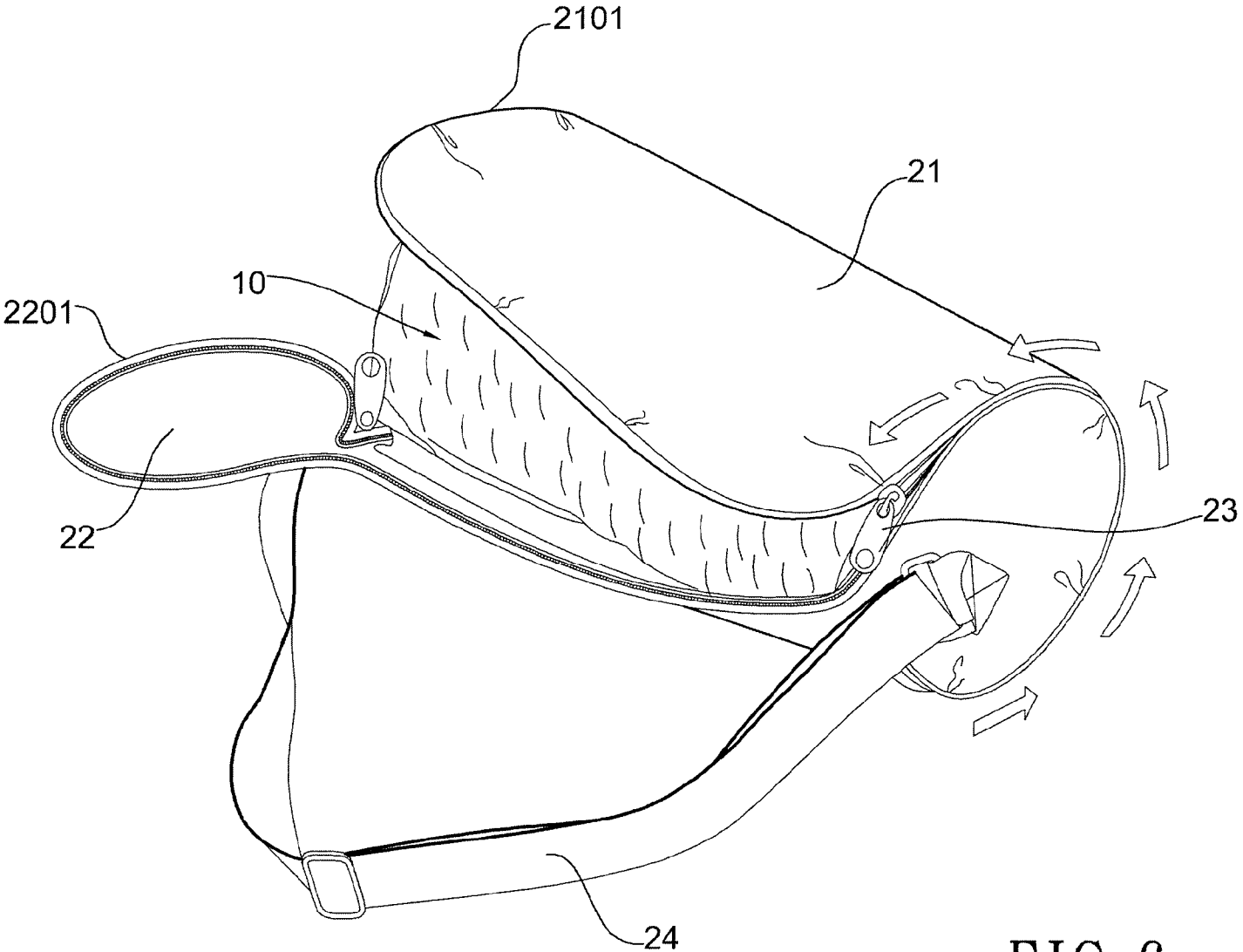
FIG. 6 is another operational perspective view of the self-enclosable inflatable mattress in FIG. 1 showing the mattress body being secured in the bag.
Figure 7:
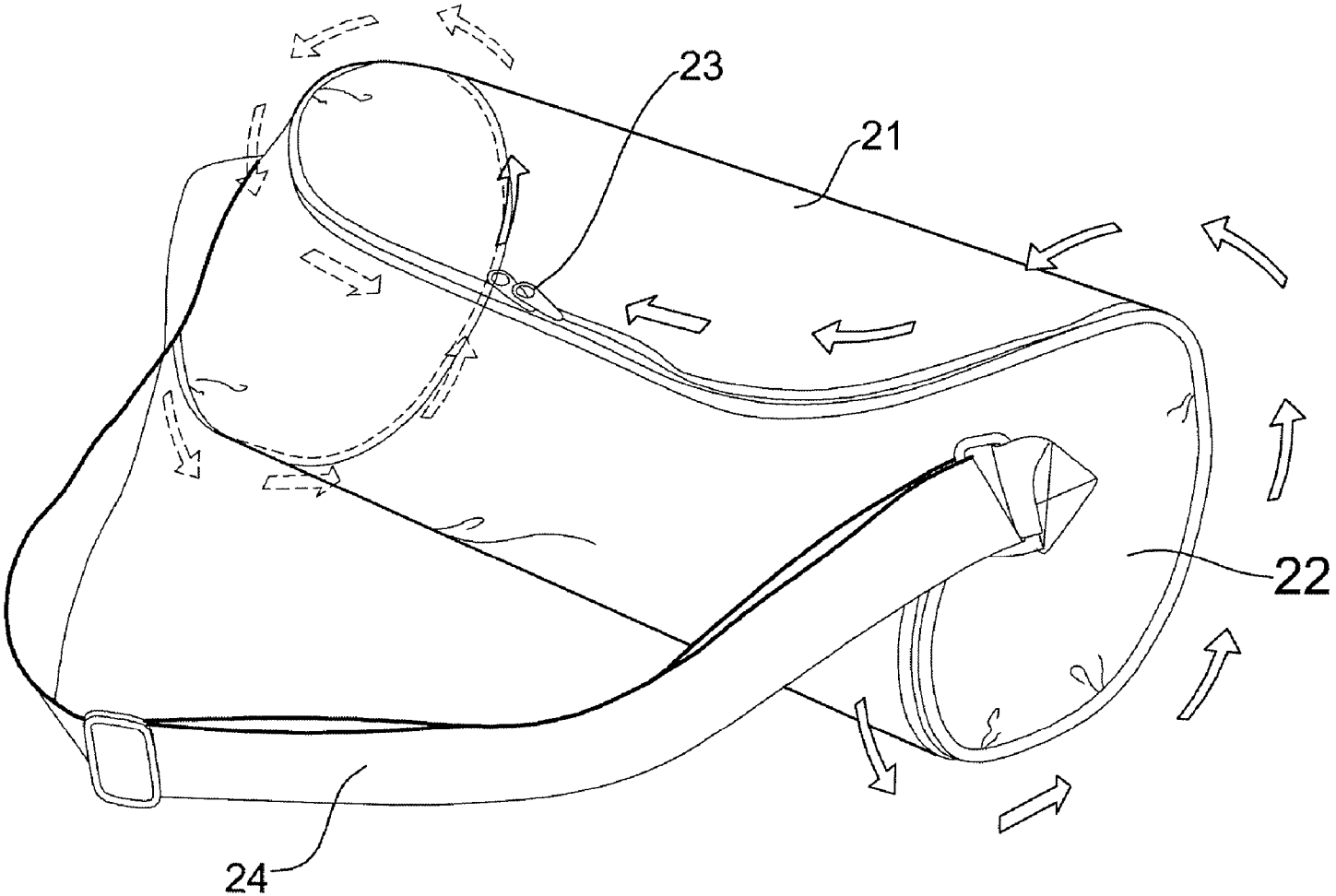
FIG. 7 is an operational perspective view of the self-enclosable inflatable mattress in FIG. 1 showing the bag being fastened.

With further reference to FIGS. 6 to 7, the rolled mattress body (10) is further wrapped with the surrounding sheet (21). Then the at least one holding sheet (22) is folded up and the periphery (2201) of the holding sheet (22) is attached to the corresponding margin of the surrounding sheet (21) by the at least one fastener (23), such that the mattress body (10) is compactly stored in the bag (20).

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A self-enclosable inflatable mattress comprising a mattress body; and a bag being connected to the mattress body and having a surrounding sheet having a margin having at least one attaching segment; and at least one holding sheet being connected to the surrounding sheet and each one of the at least one holding sheet having a periphery having an attaching section being detachably connected to a corresponding attaching segment of the surrounding sheet; and an outer surface; and at least one fastener being mounted between the attaching segment of the margin of the surrounding sheet and the corresponding attaching section of the periphery of the holding sheet, wherein the surrounding sheet and the at least one holding sheet completely enclose the mattress body when the mattress body is rolled, and wherein the bag is flush with and is attached to the mattress body when the mattress body is inflated.

2. The self-enclosable inflatable mattress of claim 1, wherein the surrounding sheet of the bag further has an attaching surface being opposite to the outer surface and attached to the mattress body.

3. The self-enclosable inflatable mattress of claim 1, wherein the bag has two holding sheets being respectively connected to the margin of the surrounding sheet.

4. The self-enclosable inflatable mattress of claim 3, wherein the mattress body has a bottom;

a sidewall; and a chamber being defined in the mattress body; and the surrounding sheet of the bag is connected to the bottom of the mattress body when the mattress body is inflated.

5. The self-enclosable inflatable mattress of claim 4, wherein the margin of the surrounding sheet has a length; and the peripheries of the two holding sheets together have a length equivalent to the length of the margin of the surrounding sheet.

6. The self-enclosable inflatable mattress of claim 5 further comprising an air pump assembly being mounted through the sidewall of the mattress body, protruding into the chamber inside the mattress body and selectively inflating or deflating the mattress body.

7. The self-enclosable inflatable mattress of claim 5, wherein each one of the at least one fastener is a zipper.

8. The self-enclosable inflatable mattress of claim 5, wherein each one of the at least one fastener is a hook and loop fastener.

9. The self-enclosable inflatable mattress of claim 1, wherein the bag has two holding sheets being respectively connected to the surrounding sheet.

10. The self-enclosable inflatable mattress of claim 9, wherein the holding sheet of the bag is connected to the mattress body.

11. The self-enclosable inflatable mattress of claim 10, wherein the margin of the surrounding sheet has a length; and the peripheries of the two holding sheets together have a length equivalent to the length of the margin of the surrounding sheet.

12. The self-enclosable inflatable mattress of claim 11, wherein the bag further has a strap having two ends being respectively attached to the outer surfaces of the holding sheets.

13. The self-enclosable inflatable mattress of claim 11, wherein the bag further has a strap having two ends being respectively attached to the outer surfaces of the holding sheets.

14. The self-enclosable inflatable mattress of claim 11 further comprising an air pump assembly being mounted through the sidewall of the mattress body, protruding into the chamber inside the mattress body and selectively inflating or deflating the mattress body.

15. The self-enclosable inflatable mattress of claim 11, wherein each one of the at least one fastener is a zipper.

16. The self-enclosable inflatable mattress of claim 11, wherein each one of the at least one fastener is a hook and loop fastener.

17. The self-enclosable inflatable mattress of claim 11, wherein the holding sheet further has at least one tape connecting the holding sheet and the bottom of the mattress body.

18. The self-enclosable inflatable mattress of claim 17, wherein the holding sheet further has at least one band connecting the surrounding sheet and the holding sheet.

* * * * *